US006661185B2

(12) United States Patent
Kominami et al.

(10) Patent No.: US 6,661,185 B2
(45) Date of Patent: Dec. 9, 2003

(54) DIMMABLE SELF-BALLASTED FLUORESCENT LAMP AND DISCHARGE LAMP OPERATING APPARATUS

(75) Inventors: Satoshi Kominami, Osaka (JP); Kenichiro Takahashi, Osaka (JP); Koji Miyazaki, Osaka (JP); Yoji Tashiro, Osaka (JP); Tetsuya Tahara, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/102,034

(22) Filed: Mar. 20, 2002

(65) Prior Publication Data

US 2002/0135320 A1 Sep. 26, 2002

(30) Foreign Application Priority Data

Mar. 22, 2001 (JP) ..... 2001-082148

(51) Int. Cl.[7] ..... G05F 1/00

(52) U.S. Cl. ..... 315/291; 315/209 R; 315/DIG. 5

(58) Field of Search ..... 315/291, 297, 315/306, 310, 313, 209 R, 210, 211, 212, 242, DIG. 4, DIG. 5, 244, 245; G05F 1/00

(56) References Cited

U.S. PATENT DOCUMENTS

| | | | | |
|---|---|---|---|---|
| 4,853,598 A | | 8/1989 | Kusko et al. | 315/101 |
| 5,089,751 A | | 2/1992 | Wong et al. | 315/279 |
| 5,463,284 A | | 10/1995 | Mattas | 315/240 |
| 5,559,405 A | * | 9/1996 | Notohamiprodjo | 315/209 R |
| 5,563,473 A | | 10/1996 | Mattas et al. | 315/240 |
| 5,969,483 A | | 10/1999 | Li et al. | 315/225 |
| 6,002,210 A | * | 12/1999 | Nilssen | 315/219 |
| 6,100,648 A | * | 8/2000 | Moisin | 315/224 |
| 6,172,464 B1 | | 1/2001 | Nilssen | 315/56 |
| 6,326,740 B1 | * | 12/2001 | Chang et al. | 315/291 |

FOREIGN PATENT DOCUMENTS

| | | | |
|---|---|---|---|
| JP | 11-111486 A | 4/1999 | H05B/41/392 |
| JP | 2001273997 A | 10/2001 | H04B/41/00 |

* cited by examiner

*Primary Examiner*—Don Wong
*Assistant Examiner*—Trinh Vo Dinh
(74) *Attorney, Agent, or Firm*—Harness, Dickey & Pierce, P.L.C.

(57) ABSTRACT

A dimmable self-ballasted fluorescent lamp includes a fluorescent lamp, a ballast and a lamp base that are formed as one unit. The ballast includes a preheating current supply circuit for supplying a preheating current to the fluorescent lamp; an inverter circuit portion for supplying a high frequency AC voltage to the fluorescent lamp; and a control circuit portion for controlling a driving frequency of the inverter circuit portion. The ballast is provided with an output current limiting element for limiting an output current from the preheating current supply circuit.

7 Claims, 6 Drawing Sheets

DIMMABLE SELF-BALLASTED FLUORESCENT LAMP AND DISCHARGE LAMP OPERATING APPARATUS

BACKGROUND OF THE INVENTION

The present invention relates to a discharge lamp operating apparatus for operating a discharge lamp (in particular, fluorescent lamp). The present invention also relates to a dimmable self-ballasted fluorescent lamp.

Fluorescent lamps are characterized by a higher efficiency and a longer life than those of incandescent lamps, and have been used in a wide range of application such as for household illumination. In particular, self-ballasted fluorescent lamps that hardly have flickers and are capable of starting to operate instantly and in which a high frequency inverter ballast and a fluorescent lamp are formed as one unit can be mounted on a socket for incandescent lamps as they are, so that there is an increasing demand for the self-ballasted fluorescent lamps in view of energy saving and natural resources saving.

FIG. 4 shows an example of the structure of a self-ballasted fluorescent lamp. The self-ballasted fluorescent lamp shown in FIG. 4 includes a fluorescent lamp 101, a lamp base 102 such as E26 type for incandescent lamps, and a circuit substrate 103. In the circuit substrate 103, wiring for a high frequency inverter ballast is formed, and circuit components 106 are provided. The circuit substrate 103 is accommodated in a case 104, and the lamp base 102 is provided in one end of the case 104. A translucent globe 105 is provided below the case 104 so as to enclose the periphery of the fluorescent lamp 101.

The fluorescent lamp 101 has a structure, for example, shown in FIG. 5. FIG. 5A schematically shows the upper surface of the fluorescent lamp 101, and FIG. 5B schematically shows the side face of the fluorescent lamp 101.

The fluorescent lamp 101 shown in FIG. 5 includes a glass bulb 107 whose inner face is coated with a phosphor, and both ends of the glass bulb 107 are sealed with filament electrodes 108 and 109. Electrode lead wires 110 and 111 are electrically connected to the filament electrodes 108 and 109. Four U-shaped glass bulbs 107 are arranged to form a square shape when viewed from the upper face, and connected to adjacent bulbs with a bridge 112. Mercury and rare gas such as argon are enclosed in the glass bulb 107. In addition, amalgam 113 is enclosed to control the vapor pressure of mercury during operation.

The high frequency inverter ballast has a structure, for example, as shown in FIG. 6. The high frequency inverter ballast shown in FIG. 6 includes a line filter 115 connected to an AC power 114, a rectifying circuit 116, a smoothing capacitor 117, a driving circuit 118, and FETs 119 and 120, which are switching elements, a chalk coil 121, and capacitors 122 and 123. Coils 124 are secondary windings of the chalk coil 121.

The line filter 115 prevents high frequency noise from flowing out to the AC power 114, and the rectifying circuit 116 and the smoothing capacitor 117 convert an AC voltage to a DC voltage. The FETs 119 and 120 turn on and off in response to a signal from the driving circuit 118, and thus the DC voltage from the smoothing capacitor 117 is converted to a high frequency AC voltage. The frequency of the high frequency AC voltage depends on the frequency at which the FETs 119 and 120 turn on and off, and generally it is set to about 50 to 80 kHz. The chalk coil 121, the capacitors 122 and 123, and the fluorescent lamp 101 form a load circuit that supplies the high frequency power to the fluorescent 101, and the lamp current that is to flow through the fluorescent lamp 101 is limited by the chalk coil 121, which is a current limiting element. The secondary windings 124 supply a preheating current to the filament electrodes 108 and 109 of the fluorescent lamp 101 by an induced voltage generated by the current flowing through the chalk coil 121.

In the circuit substrate 103 as shown in FIG. 4, multiple circuit components 106 are provided, but in the drawing, only typical components are shown. The fluorescent lamp 101 and the circuit substrate 103 in FIG. 4 are electrically connected to each other through connection pins provided on the circuit substrate 103 by for example, the approach of wrapping with the electrode lead wires 110 and 111 shown in FIG. 5B. The lamp base 102 and the circuit substrate 103 are electrically connected, and power is supplied by threading the lamp base 102 into a socket for incandescent lamps to operate the fluorescent lamp 101.

The self-ballasted fluorescent lamp shown in FIG. 4 can be exchangeable directly with an incandescent lamp, so that the self-ballasted fluorescent lamp has been widely used for the same applications as for incandescent lamps. As it has been used increasingly in a wide range, the needs for dimming in the self-ballasted fluorescent lamp as in the incandescent lamps have emerged. Unlike the incandescent lamps that can be dimmed simply by adjusting the amount of power, it was technically very difficult to dim self-ballasted fluorescent lamps, which are discharge lamps. However, in recent years, a dimmable self-ballasted fluorescent lamp has been developed (e.g., see Japanese Laid-Open Patent Publication No. 11-111486), and the needs as described above have come to be met.

However, for dimmable self-ballasted fluorescent lamps, a member having a dimming function has to be further provided in a compact self-ballasted fluorescent lamp, so that it is more difficult to produce the dimmable self-ballasted fluorescent lamp than a self-ballasted fluorescent lamp without a dimming function. It goes without saying that it is more difficult to produce the self-ballasted fluorescent lamp than an ordinary discharge operating apparatus that can be provided with a discrete ballast.

When the inventors of the present invention investigated self-ballasted fluorescent lamps that were found to be defects during production, it was turned out that the defects were generated by the following defect factor. Referring to FIG. 5, in the process of assembling the fluorescent lamp 101, the lamp base 102, the circuit substrate 103, the case 104, and the globe 105 into one unit, the electrode lead wires 110*a* and 110*b* or 111*a* and 111*b* may be brought into contact with each other.

Since the electrode lead wire 110 and 111 have to be electrically connected to the connection pins on the circuit substrate 103, these electrode lead wires are generally not subjected to a treatment for insulating coating or the like. Therefore, when these electrode leads wires are brought into contact with each other, the electrode lead wire 110 and 111 are provided with a contact resistance at the contact point. The contact resistance value changes depending on the state in which the electrode lead wire 110 and 111 are brought into contact. When the electrode lead wires 110 and 111 are brought into contact, the current output from the secondary windings 124 depends on the contact resistance value.

When the contact state of the electrode lead wires 110 and 111 is a complete short-circuit, that is, the contact resistance value is substantially 0Ω, a large current of several tens A flows from the secondary windings 124, so that the chalk coil 121 and the secondary windings 124 fail substantially instantly and the ballast stops (hereinafter, referred to as "large current failure mode"). When the contact resistance value is such that a current of about 3 A flows through the secondary winding 124, the fluorescent lamp 101 is operated while consuming about several W of power at the contact point and the ballast continues to be operated. Meanwhile, the temperature at the contact point reaches several hundred ° C., and the adjacent circuit substrate 103, the case 104 and the like may be excessively heated (hereinafter, referred to as "small current failure mode").

With respect to these problems, the inventors of the present invention found that if the electrode lead wires 110*a*, 110*b*, 111*a*, and 111*b* are covered with an insulating tube or the like in the assembly process to prevent the electrode lead wire 110*a* or 111*a* from being in contact with the electrode lead wire 110*b* or 111*b*, respectively, these problems may be avoided. However, this measure causes new problems such as an increase in the number of production processes and the cost due to the insulating tubes.

On the other hand, if it is attempted to remove defects by inspection without covering them with the insulating tubes, the following problems may be caused. In the case of the large current failure mode, a product is determined as a defect at an inspection before delivery, so that defects are not distributed in the market. However, in the case of the small current failure mode, it is difficult to determine a product as a defect, so that some defects may be distributed in the market. A sufficient measure has been provided in the unlikely event that this were to occur, but naturally it is better to prevent this problem from occurring in any case.

SUMMARY OF THE INVENTION

Therefore, with the foregoing in mind, it is a main object of the present invention to provide a dimmable self-ballasted fluorescent lamp and a discharge lamp operating apparatus that can prevent inexpensively the unwanted contact problem that is likely to occur in the assembly process.

A dimmable self-ballasted fluorescent lamp of the present invention is a self-ballasted fluorescent lamp obtained by forming a fluorescent lamp, a ballast that is electrically connected to the fluorescent lamp and a lamp base as one unit. The ballast includes a preheating current supply circuit for supplying a preheating current to the fluorescent lamp; an inverter circuit portion for supplying a high frequency AC power to the fluorescent lamp; and a control circuit portion for controlling a driving frequency of the inverter circuit portion. The ballast is provided with an output current limiting element for limiting an output current from the preheating current supply circuit.

It is preferable that the output current limiting element is constituted with a circuit element that becomes in an open state when an output current flows at a predetermined value or more, and the circuit element is a capacitive element or an inductive element.

The output current limiting element may be constituted with a circuit element that becomes in an open state when an output current flows at a predetermined value or more, and the circuit element may be a chip resistor.

In one embodiment of the present invention, the output current limiting element is constituted with a circuit element that becomes In an open state when an output current from supply means for supplying a preheating current to the fluorescent lamp flows at a predetermined value or more. The preheating current supply circuit includes a closed circuit network for supplying a preheating current to the fluorescent lamp. The circuit element is arranged on the closed circuit network.

In one embodiment of the present invention, the closed circuit network includes a secondary winding of an inductor element that functions as a current limiting element for limiting a lamp current that is to flow through the fluorescent lamp.

According to another aspect of the present invention, a discharge lamp operating apparatus includes a discharge lamp and a ballast for operating the discharge lamp. The ballast includes preheating current supply means for supplying a preheating current to the discharge lamp; and output current limiting means for limiting an output current from the preheating current supply means.

In one embodiment of the present invention, the discharge lamp operating apparatus is a self-ballasted fluorescent lamp obtained by forming a lamp base, the ballast that is electrically connected to the lamp base, and the discharge lamp as one unit. The output current limiting element is constituted with a circuit element that becomes in an open state when an output current flows at a predetermined value or more.

According to the present invention, an output current limiting element for limiting an output current from a preheating current supply circuit is provided in a ballast, so that the problem of unwanted contacts, which are likely to occur in the assembly process, can be prevented at a low cost. Furthermore, a capacitive or inductive element is used as the output current limiting element, so that a power loss of the output current limiting means in the regular state where the electrode lead wires are not in contact can be reduced.

DETAILED DESCRIPTION OF THE INVENTION

The inventors of the present invention made in-depth research to prevent excessive heating (small current failure mode) of a circuit substrate and a case at a lower cost when an unwanted contact of power electrode lead wires that is likely to occur during an assembly process has occurred, and found that the problem of the small current failure mode can be solved if an output current limiting element for limiting an output current from a preheating current supply circuit is provided in a predetermined portion of a ballast, and thus they achieved the present invention.

Hereinafter, embodiments of the present invention will be described with reference to the accompanying drawings. In the following drawings, for the sake of simplification of description, the components having substantially the same function bear the same numerals. The present invention is not limited to the following embodiments.

Figure 1:
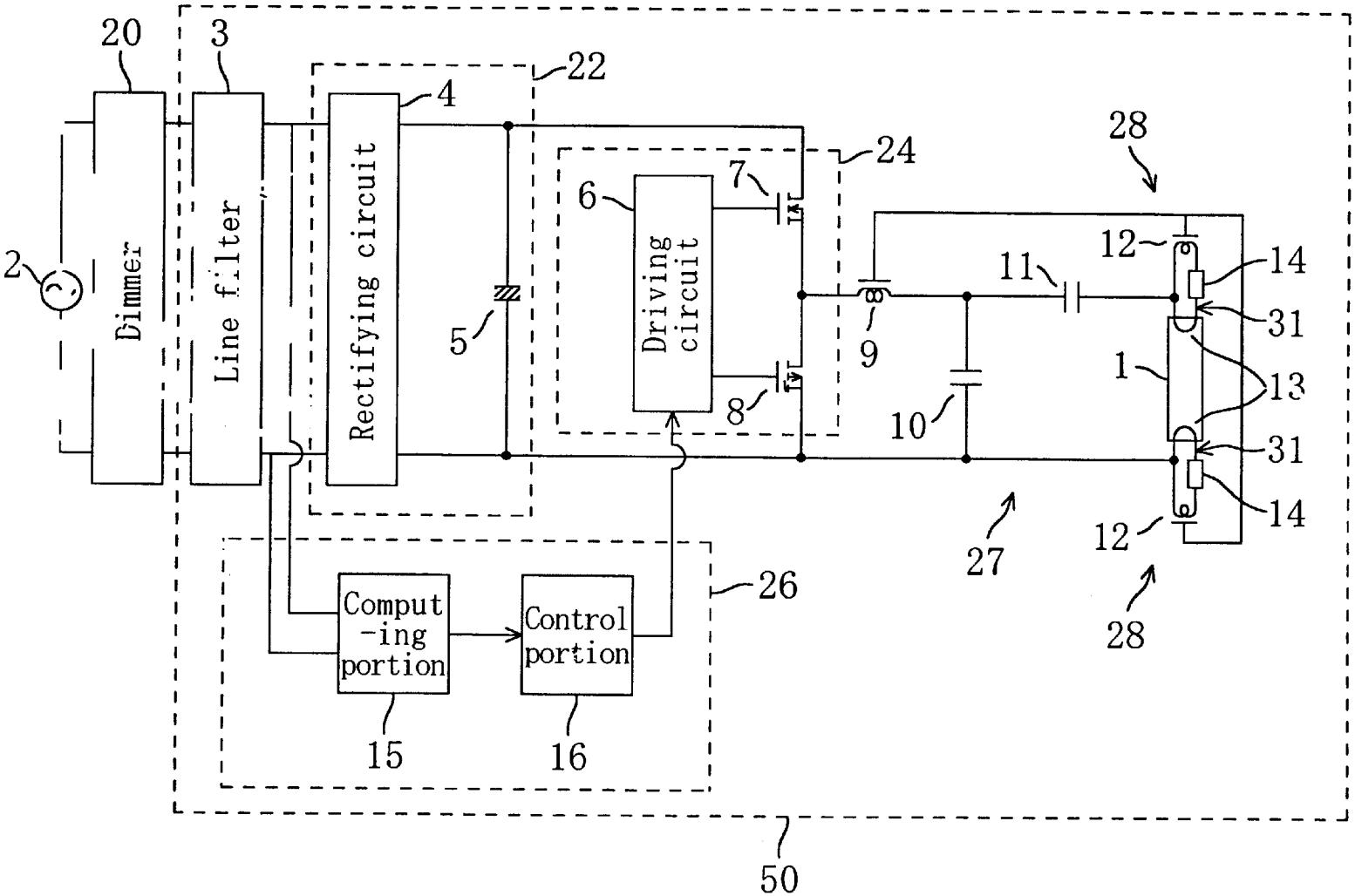
FIG. 1 is a view showing the structure of a discharge lamp operating apparatus of an embodiment of the present invention.

FIG. 1 shows a circuit structure of a discharge lamp operating apparatus of an embodiment of the present invention.

The discharge operating apparatus of this embodiment includes a discharge lamp (e.g., fluorescent lamp) 1, and a ballast 50 for operating the discharge lamp. The ballast 50 includes preheating current supply means (preheating current supply circuit) 28 for supplying a preheating current to the discharge lamp 1, and output current liming means (output current limiting element) 14 for limiting output current from the preheating current supply means 28. The ballast 50 is configured such that the discharge lamp 1 can be dimmed. More specifically, the ballast 50 has a control circuit portion 26 for varying light output of the discharge lamp 1. Moreover, the discharge lamp operating apparatus of this embodiment can be configured as a self-ballasted fluorescent lamp 1000 in which a lamp base 102, and a ballast 113 electrically connected to the lamp base 102 and a discharge lamp 101 are formed as one unit, as shown in FIG. 2.

Figure 2:
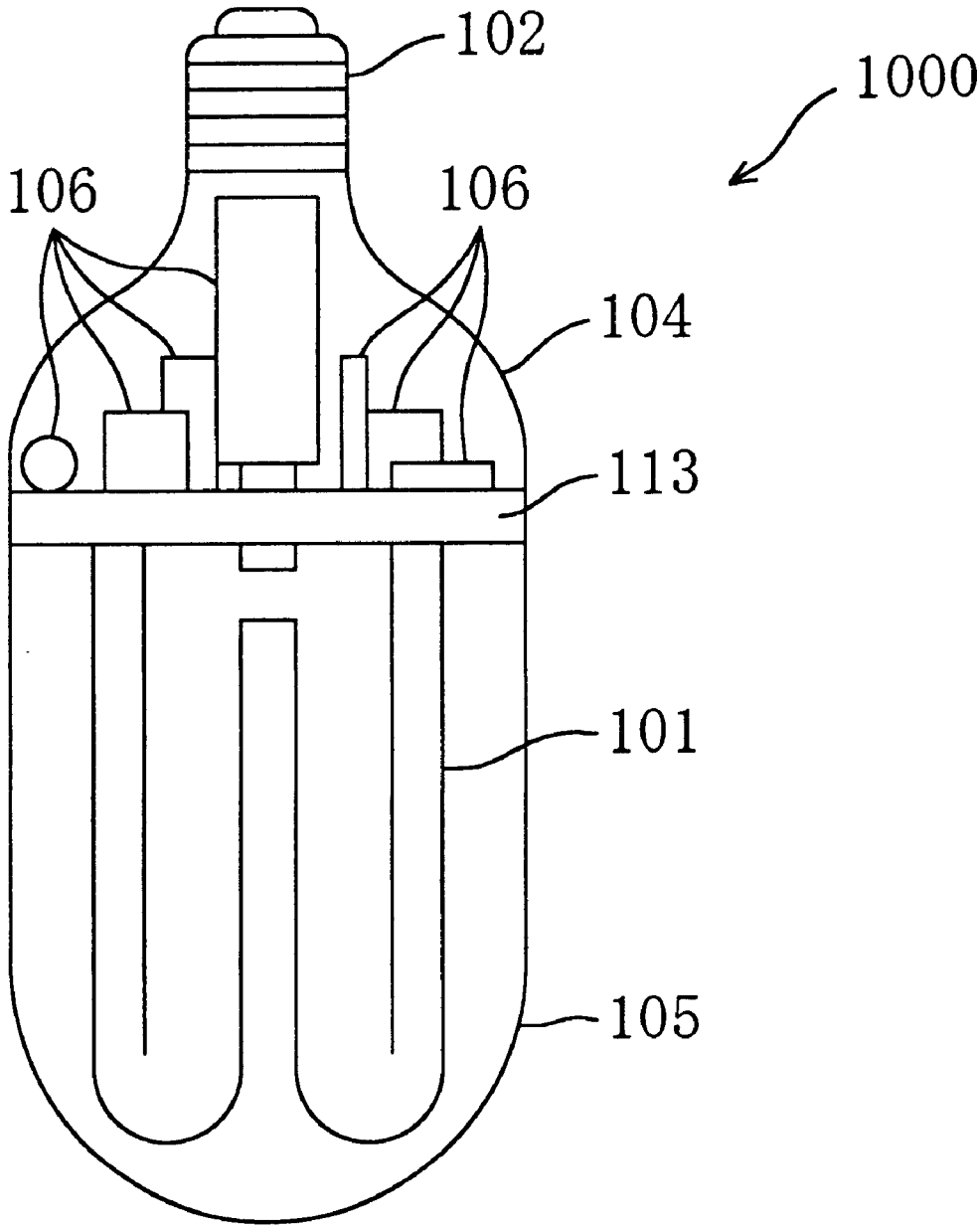
FIG. 2 is a view showing the structure of a self-ballasted fluorescent lamp of an embodiment of the present invention.
Figure 5A:
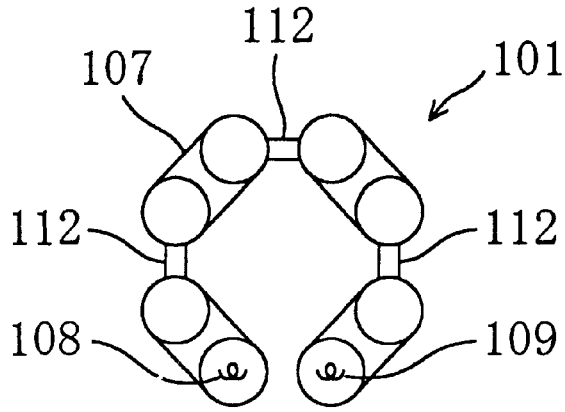
FIG. 5A is a top view showing an example of the structure of a fluorescent lamp used in a self-ballasted fluorescent lamp.
Figure 5B:
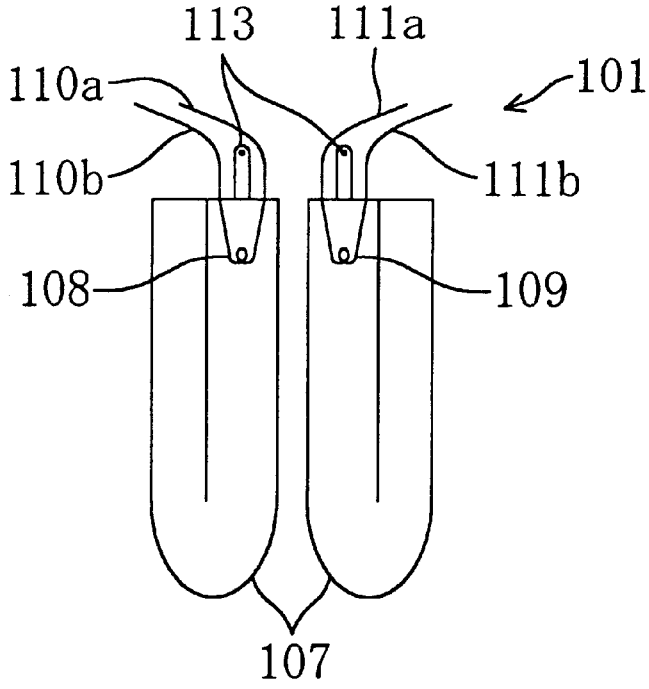
FIG. 5B is a side view showing the structure of the fluorescent lamp of FIG. 5A.
Figure 6:
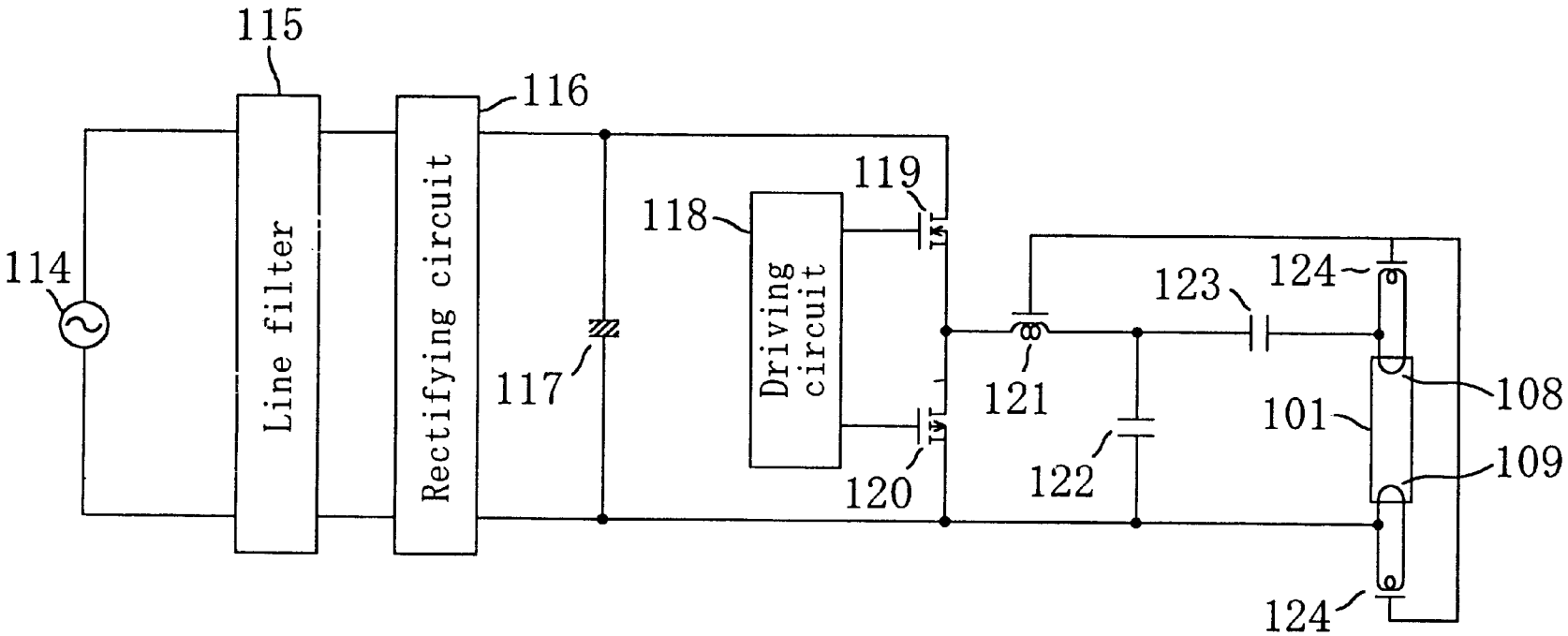
FIG. 6 is a view showing an example of the structure of a conventional high frequency inverter ballast.

The structure of the self-ballasted fluorescent lamp 1000 shown in FIG. 2 is basically the same as the structure shown in FIG. 6, except that the ballast 50 is formed on the circuit substrate 113. That is to say, the structure of the self-ballasted fluorescent lamp 1000 shown in FIG. 2 includes a fluorescent lamp 101, a lamp base 102 such as E26 type for incandescent lamps, and a circuit substrate 113, as in the structure shown in FIG. 6. In the circuit substrate 113, wiring for a ballast 50 is formed, and circuit components 106 are provided. The circuit substrate 113 is accommodated in a case 104, and the lamp base 102 is provided in one end of the case 104. A translucent globe 105 is provided below the case 104 so as to enclose the periphery of the fluorescent lamp 101. The fluorescent lamp 101 has a structure, for example, as shown in FIG. 5.

Hereinafter, the structure of this embodiment will be described in details. The self-ballasted fluorescent lamp 1000 is a dimmable self-ballasted fluorescent lamp, and as shown in FIG. 1, the ballast 50 for supplying power to the fluorescent lamp 1 which is a discharge lamp, to operate the fluorescent lamp 1 includes AC/DC converting means (rectifying circuit portion) 22, DC/AC converting means (inverter circuit portion) 24, and a control circuit portion 26. The ballast 50 is connected to an AC power 2 via a dimmer 20. It is preferable that a line filter 3 is inserted between the dimmer 20 and the AC/DC converting means 22. Furthermore, a resonance circuit (or load circuit) 27 including capacitors 10 and 11 and a chalk coil 9 is formed between the DC/AC converting means 24 and the fluorescent lamp 1, and a preheating current supply circuit 28 for supplying a preheating current to the fluorescent lamp 1 is connected to the fluorescent lamp 1.

The AC power 2 is a power, for example, of 60 Hz and 100V. The dimmer 20 is phase control means for controlling the phase of the AC power 2, and is constituted with, for example, a triac. A dimmer for incandescent lamps (e.g., volume type dimmer) can be used as the dimmer 20. The line filter 3 is constituted by an inductance element, a capacitor and the like, and prevents high frequency noise from flowing out to the AC power 2. The AC/DC converting means 22 includes a rectifying circuit 4 and a smoothing capacitor 5, and it rectifies, smoothes and converts an AC voltage that has been input via the line filter 3 and has been phase-controlled to a DC voltage.

The DC/AC converting means (inverter circuit portion) 24 converts the DC output voltage from the AC/DC converting means 22 to a high frequency AC voltage of, for example 50 kHz. The DC/AC converting means 24 includes FETs 7 and 8, which are switching elements, and a driving circuit 6 for driving the FETs 7 and 8. A control circuit portion 26 for controlling the driving frequency of the DC/AC converting means (inverter circuit portion) 24 is connected to the driving circuit 6. The control circuit portion 26 includes a computing portion 15 and a control portion 16. The computing portion 15 computes the states (e.g., conductive angles, conductivity periods, or integral values based on a half cycle of the phase-controlled AC voltage) of the AC voltage that is phase-controlled by the dimmer 20, and the control portion 16 varies an output from the DC/AC converting means 24 based on a signal output from the computing portion 15 (that is, in accordance with the output signal level of the computing portion 15). The signal from the control portion 16 is input to the driving circuit 6, and thus the operations of the FETs 7 and 8 are controlled. This control can vary the light output of the fluorescent lamp 1, that is, the fluorescent lamp 1 can be dimmed, by adjusting the dimmer 20.

It should be noted that the computing portion 15 and the control portion 16 can be configured to be one circuit (e.g., a dimming level detecting circuit or a phase detecting circuit) instead of configuring the separate circuits. The control portion 16 and the driving circuit 6 can be configured to be one circuit (e.g., as a combination of two components, an inverter control circuit or a FET control circuit). If the control circuit portion 26 is configured so as to control the inverter circuit portion 24 based on an integral value based on a half cycle of the phase-controlled AC voltage (or substantially average value in one cycle obtained from the integral values), the light output from the fluorescent lamp 1 can be varied, not linearly but non-linearly, as dimming of an incandescent lamp so that unnaturalness felt by users can be reduced.

The resonance circuit 27 including the chalk coil 9 and the capacitors 10 and 11 is connected to the FETs 7 and 8 in the inverter circuit portion 24, as shown in FIG. 1. Output current limiting means (output current limiting element) 14 from the secondary windings 12 are provided between the secondary windings 12 of the chalk coil 9 constituting the means 28 for supplying a preheating current to the fluorescent lamp 1 and the filament electrodes 13 of the fluorescent lamp 1. The portions 31 extending from the filament electrodes 13 correspond to the electrode lead wires 110 and 111 shown in FIG. 5B.

The output current limiting means (output current limiting element) 14 is constituted with a circuit element that becomes in an open state when an output current from the supply means 28 for supplying a preheating current to the fluorescent lamp 1 flows at a predetermined value or more. Preferable examples of the circuit element are a capacitive element or an inductive element, and for example, a chip capacitor can be used. Herein, a current value when the output current limiting element (e.g., chip capacitor) 14 is broken so that the circuit becomes open constitutes the above-described "predetermined value". As shown in FIG. 1, the preheating current supply circuit 28 includes a closed circuit network and the secondary winding 12 of the inductor element 9 functioning as a current limiting element for limiting lamp current flowing through the fluorescent lamp 1 and the output current limiting element 14 are arranged on this closed circuit network. That is to say, the output current limiting element 14 is arranged on the closed circuit network.

As the preheating current supply circuit 28, a circuit whose structure is not a closed circuit network as shown in FIG. 1 can be used, but in the case of a dimmable lamp, it is preferable to use the preheating current supply circuit 28 of a closed circuit network structure shown in FIG. 1, which is relatively easy to apply preheating. The reason for this is as follows. In the case of lamps without dimming operation function, the lamps are operated constantly at 100% output, so that the lamp can be started to operate relatively easily without giving much consideration to preheating. On the other hand, in the case of dimmable lamps, the lamps have to be operated at, for example, about 30% output (low wattage), so that preheating is an important point, compared with the lamps without the dimming function. When a lamp is started to operate at a low wattage, a lamp voltage becomes high, so that the lifetime of the lamp is shortened because of liability of scattering of an emitter in the electrode. However, when preheated appropriately, the scattering of an emitter can be suppressed so that the lifetime of the lamp can be extended. Among dimmable self-ballasted fluorescent lamps, self-ballasted fluorescent lamps that can be dimmed in a very wide range from 5% or 10% to 100% are more likely to be required to operate at a lower wattage than self-ballasted fluorescent lamps that can be dimmed in a range from 30% or 40% to 100%, so that a technical significance of preheating is more important. In order to apply the technique of this embodiment to the self-ballasted fluorescent lamps that can be dimmed in such a wide range, it is preferable to use a closed network structure shown in FIG. 1 for the preheating current supply circuit 28.

Next, the operation and the function of each component of the self-ballasted fluorescent lamp 1000 will be described. As described above, the line filter 3 prevents high frequency noise from flowing out to the AC power 2, and the rectifying circuit 4 and the smoothing capacitor 5 convert an AC voltage from the to the AC power 2 to a DC voltage. The FETs 7 and 8 turn on and off in response to a single from the driving circuit 6, to convert the DC voltage from the smoothing capacitor 5 to a high frequency AC voltage. The frequency of the high frequency AC voltage depends on the frequency at which the FETs 7 and 8 turn on and off, and is set to, for example, 70 kHz. The control circuit portion 26 controls the operation of the driving circuit 6 and thus the frequency at which the FETs 7 and 8 turn on and off in accordance with the dimming level of the dimmer 20. The function of the driving circuit 6 can be performed by the control portion 16 of the control circuit portion 26.

The chalk coil 9, the capacitors 10 and 11, and the fluorescent lamp 1 form a load circuit that supplies the high frequency power to the fluorescent lamp 1, and the lamp current that is to flow through the fluorescent lamp 1 is limited by the chalk coil 9, which is a current limiting element. The secondary windings 12 supply a preheating current to the filament electrodes 13 and 109 of the fluorescent lamp 1 by an induced voltage generated by the current flowing through the chalk coil 9. The chip capacitor 14 is arranged on the closed circuit network for supplying a preheating current to the filament electrode 13, and the chip capacitor 14 of this embodiment is a compact one that becomes in the open state (failure state) when an output current from the secondary winding 12 is for example, 1 A or more. Moreover, for the chip capacitor 14, the capacitance is determined such that the impedance at a frequency of 70 kHz for stable operation is sufficiently smaller than the impedance of the filament electrode 13. For example, when the impedance of the filament electrode 13 at a frequency of 70 kHz for stable operation is 20Ω and the capacitance is set to about 1 μF, then the impedance of the chip capacitor 14 is about 2Ω, and thus the impedance is sufficiently smaller than that of the filament electrode. The conditions for other circuit elements than the chip capacitor 14 are as follows, for example: chalk coil 9; 1550 μH, capacitor 10; 5600 pF, capacitor 11; 0.1 μF.

In this case, when the electrode lead wires (see FIG. 5B) of the fluorescent lamp 1 are brought into contact in the assembly process, an output current that is more than a regular preheating current value, for example, a current of 1 A flows through the secondary winding 12 and the chip capacitor 14, depending on the contact resistance value at the contact point of the electrode lead wires. At this point, the chip capacitor 14 has no capability that allows a current of 1 A to flow continuously, and therefore the chip capacitor 14 becomes in the open state (failure state) substantially instantly. Thus, the output current from the secondary winding 12 is limited and becomes 0 A, so that the contact point is not heated, and the circuit substrate, the case and the like are not excessively heated. In this manner, the self-ballasted fluorescent lamp in which the electrode lead wires are in contact becomes a defect, and therefore it is possible to determine detects easily even in the small current failure mode.

Furthermore, in the regular case where electrode lead wires of the fluorescent lamp 1 are not in contact, the impedance of the chip capacitor 14 is sufficiently smaller than that of the filament element 13, so that the heating current is substantially not reduced. The preheating current liming means is a capacitive element (capacitor) and therefore a power loss hardly occurs.

According to this embodiment, an element for limiting an output current from the secondary winding, which is means for supplying a preheating current, that becomes in the open state when the output current flows at a predetermined value or more is provided on the closed circuit network for supplying a preheating current to the filament electrodes 13 of the fluorescent lamp 1. Thus, the electrode lead wires of the fluorescent lamp 1 are prevented from being in contact with each other in the assembly process and thus heat generation can be prevented, which prevents the circuit substrate, the case and the like from being excessively heated. Furthermore, the output current limiting means is a capacitive element (capacitor), so that in the regular state where the electrode lead wires of the fluorescent lamp 1 are not in contact, an extra power loss hardly occurs.

In this embodiment of the present invention, the frequency for operation is 70 kHz, but other frequencies can be used. In general, it is set to about 50 to 100 kHz. The chip capacitor, which is an output current limiting element, is assumed to become in the open state when a current of 1 A flows, but the open state can be reached at other current values. The chip capacitor is used as the output current limiting element, but any other element can be used, as long as it can become in the open state when the output current with a predetermined current value or more flows. For example, a chip resister, a chip inductor or the like can be used. However, it is necessary to take power loss into consideration if a chip resistor is used, so that it is preferable to use a capacitive element or inductive element as the preheating current limiting element.

Figure 3:
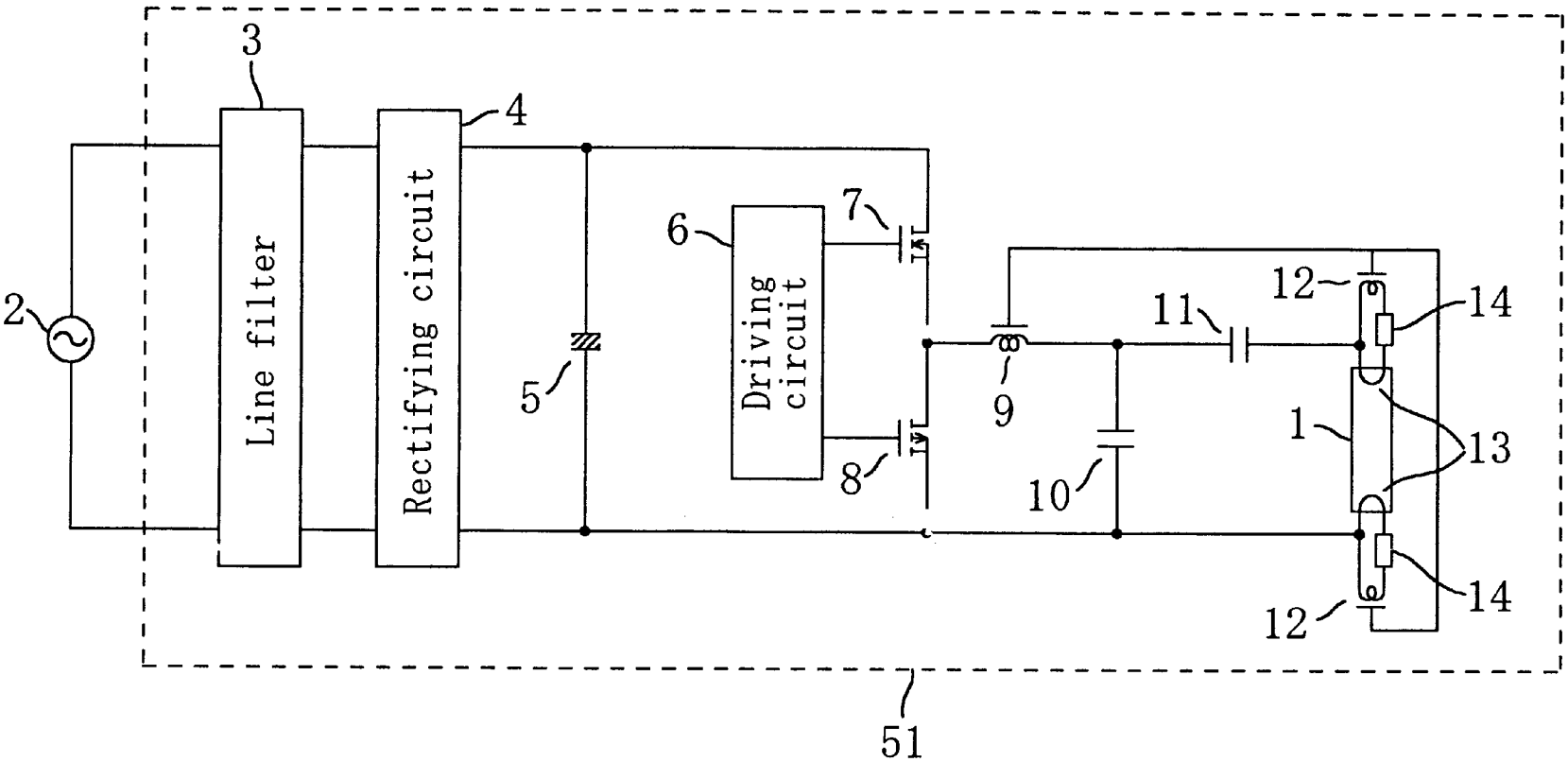
FIG. 3 is a view showing the structure of a discharge lamp operating apparatus of an embodiment of the present invention.
Figure 4:
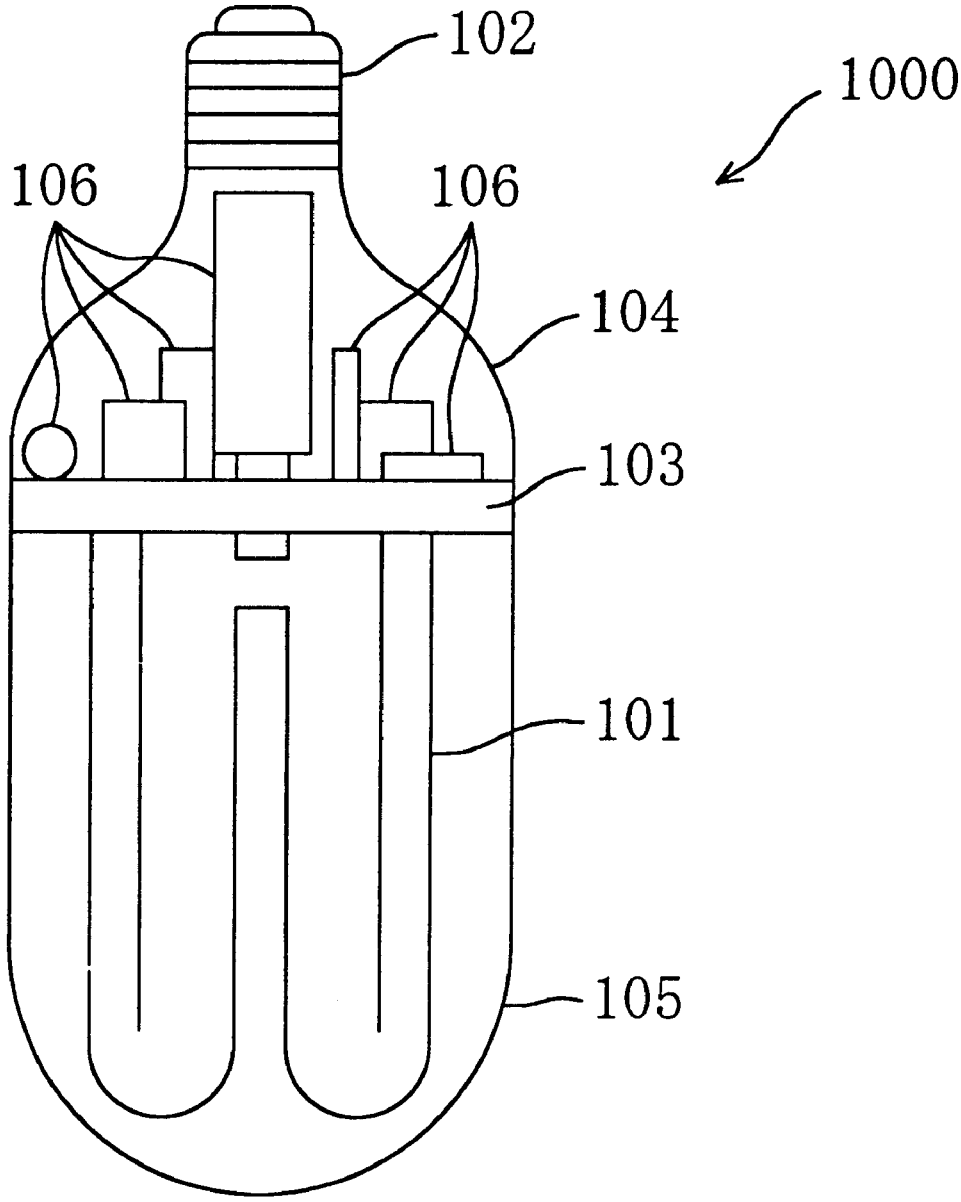
FIG. 4 is a view showing an example of the structure of a conventional self-ballasted fluorescent lamp.

Furthermore, in the above embodiment, dimmable self-ballasted fluorescent lamps have been described as the discharge lamp operating apparatus, but the present invention is not limited thereto. The present invention has an advantage on a self-ballasted fluorescent lamp including a ballast 51 without a dimming function and a fluorescent lamp 1, as shown in FIG. 3. This is because the small current failure problem arises regardless of the dimming function. The incidence of unwanted contacts of the electrode lead wires is higher in more compact lamps such as self-ballasted fluorescent lamps when they are assembled. FIG. 3 shows the structure in which the control circuit portion 26 and the dimmer 20 in FIG. 1 are not provided.

In either a case where the lamp structure is compact or not, when the electrode lead wires are desired to be attached automatically, for example by a machine, and the electrode lead wires have a slack, the slack may cause the small current failure mode problem. As described above, it is not easy to detect the small current failure mode, so that the technique of this embodiment is an effective approach to solve the small current failure mode problem in both the self-ballasted fluorescent lamps and the regular discharge lamp operating apparatus.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A dimmable self-ballasted fluorescent lamp obtained by forming a fluorescent lamp, a ballast that is electrically connected to the fluorescent lamp and a lamp base as one unit, the ballast comprising:

a preheating current supply circuit for supplying a preheating current to the fluorescent lamp;

an inverter circuit portion for supplying a high frequency AC power to the fluorescent lamp; and a control circuit portion for controlling a driving frequency of the inverter circuit portion, wherein the ballast is provided with an output current limiting element for limiting an output current from the preheating current supply circuit; wherein the output current limiting element is constituted with a circuit element that becomes in an open state when an output current flows at a predetermined value or more, and the circuit element is a capacitive element or an inductive element.

2. The dimmable self-ballasted fluorescent lamp according to claim 1, wherein the output current limiting element is constituted with a circuit element that becomes in an open state when an output current flows at a predetermined value or more, and the circuit element is a chip resistor.

3. The dimmable self-ballasted fluorescent lamp according to claim 1, wherein the output current limiting element is constituted with a circuit element that becomes in an open state when an output current from supply means for supplying a preheating current to the fluorescent lamp flows at a predetermined value or more, the preheating current supply circuit includes a closed circuit network for supplying a preheating current to the fluorescent lamp, and the circuit element is arranged on the closed circuit network.

4. The dimmable self-ballasted fluorescent lamp according to claim 1, wherein the closed circuit network includes a secondary winding of an inductor element that functions as a current limiting element for limiting a lamp current that is to flow through the fluorescent lamp.

5. The discharge lamp operating apparatus according to claim 1, wherein the discharge lamp operating apparatus is a self-ballasted fluorescent lamp obtained by forming a lamp base, the ballast that is electrically connected to the lamp base, and the discharge lamp as one unit, and the output current limiting element is constituted with a circuit element that becomes in an open state when an output current flows at a predetermined value or more.

6. A dimmable self-ballasted fluorescent lamp comprising:

a preheating current supply circuit for supplying a preheating current to the fluorescent lamp;

an inverter circuit portion for supplying a high frequency AC power to the fluorescent lamp;

a control circuit portion for controlling a driving frequency of the inverter circuit portion; and an output current limiting element for limiting an output current from the preheating current supply circuit, wherein the output current limiting element includes a circuit element that becomes in an open state when an output current flows at a predetermined value or more.

7. The dimmable self-ballasted fluorescent lamp according to claim 6, wherein the circuit element is at least one of a capacitive element, an inductive element, and a resistive element.

* * * * *